US010023333B2

(12) United States Patent
Corominas

(10) Patent No.: US 10,023,333 B2
(45) Date of Patent: Jul. 17, 2018

(54) VACUUM ASSISTED NOZZLE AND APPARATUS

(71) Applicant: The Procter & Gamble Company, Cincinnati, OH (US)

(72) Inventor: Francesc Corominas, Grimbergen (BE)

(73) Assignee: The Procter & Gamble Company, Cincinnati, OH (US)

( * ) Notice: Subject to any disclaimer, the term of this patent is extended or adjusted under 35 U.S.C. 154(b) by 75 days.

(21) Appl. No.: 15/062,998

(22) Filed: Mar. 7, 2016

(65) Prior Publication Data

US 2017/0253355 A1 Sep. 7, 2017

(51) Int. Cl.

| | |
|---|---|
| ***B65B 3/04*** | (2006.01) |
| ***B65B 39/00*** | (2006.01) |
| ***B67C 3/26*** | (2006.01) |
| ***B65B 39/04*** | (2006.01) |
| ***B65B 39/14*** | (2006.01) |
| ***B65B 9/04*** | (2006.01) |

(52) U.S. Cl.

CPC ..... *B65B 3/04* (2013.01); *B65B 9/042* (2013.01); *B65B 39/001* (2013.01); *B65B 39/04* (2013.01); *B65B 39/14* (2013.01); *B67C 3/2608* (2013.01); *B65B 2009/047* (2013.01); *B65B 2039/009* (2013.01); *B65B 2210/02* (2013.01)

(58) Field of Classification Search

CPC .. B65B 1/04; B65B 3/04; B65B 39/04; B65B 39/001; B65B 43/50; B67C 3/2608

USPC ..... 141/119, 311 A

See application file for complete search history.

(56) References Cited

U.S. PATENT DOCUMENTS

| | | | | |
|---|---|---|---|---|
| 3,792,724 | A * | 2/1974 | Hunter | B29C 65/18 141/115 |
| 3,834,430 | A | 9/1974 | Fechheimer | |
| 3,895,748 | A * | 7/1975 | Klingenberg | D21H 5/0045 118/411 |
| 4,313,476 | A * | 2/1982 | Bennett | B65B 39/02 141/119 |
| 4,576,210 | A * | 3/1986 | Lepisto | B65B 1/18 141/115 |
| 4,606,382 | A * | 8/1986 | Biller | B67C 3/206 141/1 |
| 5,193,593 | A * | 3/1993 | Denis | B65B 39/00 141/10 |
| 5,988,526 | A * | 11/1999 | Tzeng | B05B 1/28 239/119 |
| 7,464,732 | B2 * | 12/2008 | Nishino | B67C 3/04 141/144 |
| 2011/0171744 | A1 | 7/2011 | Saegusa | |

* cited by examiner

*Primary Examiner* — Timothy L Maust

(74) *Attorney, Agent, or Firm* — Lauren Christine Gonzalez

(57) ABSTRACT

An apparatus having a nozzle, a fluid flow conduit, a fluid flow discharge opening, a fluid flow discharge opening area, a fluid flow valve, a vacuum, a vacuum conduit, a vacuum opening, a vacuum valve, and a vacuum opening area wherein the vacuum opening is spatially proximate to the fluid flow discharge opening, the vacuum opening area to the fluid flow discharge opening area has a ratio of less than or equal to 1, and the fluid flow valve and vacuum valve are coupled.

17 Claims, 5 Drawing Sheets

VACUUM ASSISTED NOZZLE AND APPARATUS

FIELD OF THE INVENTION

Apparatus, and methods of using the same, for dispensing fluid.

BACKGROUND OF THE INVENTION

Unit dose articles filled with compositions, particularly household care compositions such as laundry detergent, are becoming more popular with consumers. Generally, such articles are made in part by forming compartments in a web, for example, a web of water-soluble film, filling the compartments with a composition, and then sealing and separating the articles. The webs are often disposed on a moving surface, such as on a rotary drum or on a horizontal conveyor belt, and the compartments are filled as they move past filling nozzles. In larger scale manufacturing lines there are typically multiple filling nozzles in a lane in the machine direction MD and multiple lanes in parallel with one another in the cross direction CD. For example, a manufacturer may have twelve lanes, each lane having four nozzles, for a total of forty-eight nozzles. The nozzles are typically crowded closely together to allow more nozzles to fit within compact space. The lanes are typically crowded closely together to allow more lanes to fit within compact space. Having more nozzles allows for an increase in the number of compartments that can be filled simultaneously. Manufacturers are continually looking for ways to increase the speed and efficiency of the process of filling compartments with fluid compositions.

The type of composition being dispensed can provide filling challenges. During manufacture, the time it takes to fill a compartment with a fluid depends a great deal on the rheological properties of the fluid. Higher-viscosity compounds may result in a filament or string that forms and hangs down from the filling nozzle at the end of the filling event, and this filament or string takes some time to break up. The time to break up is typically longer than desired and imposes a limitation to the speed at which consecutive filling events can take place. The time to break up sometimes can be the controlling factor for selecting the maximum speed at which the filling operation can run, as speeding up the filling operation before the filament or string breaks up will cause fluid to fall on the web in between the compartments. Lower-viscosity compounds may splash out of cavities when dispensed quickly which will also cause fluid to fall on the web in between the compartments. Fluid located on the web in between the compartments causes difficulty in sealing and separating the articles.

To compensate for the problem associated with stringing, a valve can be joined to the tip of the filling nozzle that only opens when filling is needed and closes rapidly at the end of the filling event. In a compact filling apparatus, there is little space to install valves next to all of the nozzles. Furthermore, adding valves would also add extra weight to reciprocating shuttles that are often employed to enable continuous web motion. Starting and stopping a heavy shuttle can result in over stressing and fatigue of the driving motor and moving parts. Additionally, having a valve does not always solve the problem because there are physical parts on the exit side of the valve that can become wetted with fluid and can give rise to further stringing and dripping.

In view of the above, there is a continuing unaddressed need for lightweight apparatus and processes that are capable of quickly filling a succession of compartments with minimal stringing and dripping of the fluid and that are capable of cleanly shutting off the flow of fluid to avoid stringing and dripping the fluid outside of the compartments.

SUMMARY OF THE INVENTION

An apparatus providing a filling cycle comprising: a nozzle comprising a nozzle inlet and a fluid flow discharge opening in fluid communication with the nozzle inlet, wherein the fluid flow discharge opening has a fluid flow discharge opening area; a fluid flow conduit in fluid communication with the nozzle inlet, the fluid flow conduit in fluid communication with a fluid source; a fluid flow valve in line with the fluid flow conduit, wherein the fluid flow valve has a fluid flow valve open position and a fluid flow valve closed position; a vacuum conduit in fluid communication with a vacuum source, the vacuum conduit comprising a vacuum opening, wherein the vacuum opening is spatially proximate to the fluid flow discharge opening, wherein the vacuum opening has a vacuum opening area, wherein the vacuum opening area to the fluid flow discharge opening area has a ratio of less than or equal to 1; and a vacuum valve in line with the vacuum conduit, wherein the vacuum valve has a vacuum valve open position and a vacuum valve closed position.

DETAILED DESCRIPTION OF THE INVENTION

As used herein, the term "compartment" is used in the broadest scope to include any bottle, chamber, vessel, box, pouch, such as thermoformed water-soluble film, water-soluble film, plastic bottles, glass bottles, soluble-unit dose pouches, or the like including a breadth of sizes. Compartments can be (but not necessarily) empty, i.e., devoid of fluid, when conveyed through the dispensing processes or partially filled compartments can be of any discrete size.

As used herein, the term "cross direction" (CD) refers to a direction perpendicular to the machine direction (MD).

As used herein, the term "dosing amplitude" refers to the measurement of the width of the fluid stream at the widest part leaving the nozzle at a pre-determined distance from the fluid flow discharge opening.

As used herein, the term "joined to" encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined to" encompasses configurations in which an element is secured to another element at selected locations, as well as configurations in which an element is completely secured to another element across an entire surface of one of the elements.

As used herein, the term "machine direction" (MD) refers to the direction of material flow through a process. In addition, relative placement and movement of material may be described as flowing in the machine direction through a process from upstream in the process to downstream in the process.

Figure 1:
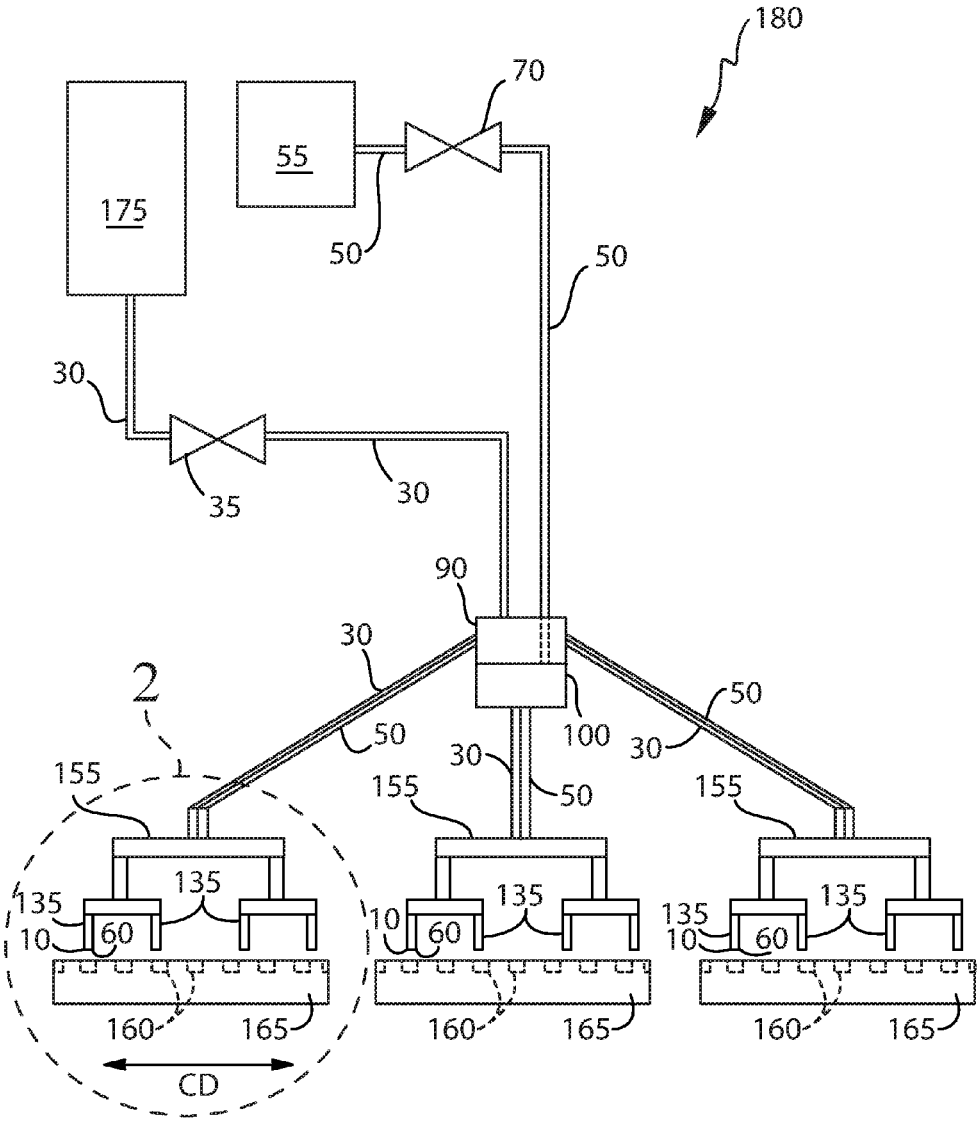
FIG. 1 is a view of a fluid filling assembly.

FIG. 1 is a view of a fluid filling assembly 180 encompassing the vacuum assisted nozzle apparatus 135 the cross direction (CD) being indicated in the figure. The vacuum assisted nozzle apparatus 135 may be attached to a shuttle 155. The vacuum assisted nozzle apparatus 135 may comprise a fluid flow manifold 90 and a vacuum manifold 100. The fluid flow manifold 90 may be in line with a plurality of fluid flow conduits 30 between a fluid flow valve 35 and a plurality of nozzles 10. The vacuum manifold 100 may be in line with a plurality of vacuum conduits 50 between a vacuum valve 70 and a vacuum opening 60. The plurality of fluid flow conduits 30 may be in fluid communication with a fluid source 175. The fluid flow valve 35 may reside between the plurality of fluid flow conduits 30 and the fluid source 175. The plurality of vacuum conduits 50 may be in fluid communication with a vacuum source 55. The vacuum valve 70 may reside between the plurality of vacuum conduits 50 and the vacuum source 55. The fluid flow valve 35 and the vacuum valve 75 may be coupled by a coupling element 190. The coupling element 190 may be operatively connected to both the fluid flow valve 35 and to the vacuum valve 75. The coupling element 190 may be connected to the fluid flow valve 35 and to the vacuum valve 75 by a coupling connector connected to the coupling element 190 and to the fluid flow valve 35 and further connected to the coupling element 190 and to the vacuum valve 70. The fluid filling assembly 180 may be used to dispense fluid into molds 160 on a rotary drum 165, part of the rotary drum 165 being shown in FIG. 1. The fluid filling assembly 180 may be used to dispense fluid into molds 160 moving on a horizontal conveyor belt. In the case of the fluid flow conduit 30, nozzle 10, and fluid source 175, the fluid to be transported there through may be selected from the group consisting of liquid, fluidized solid, semi-liquid, semi-solid, granular, semi-granular, gel, paste, slurry, liquid with a suspension of particles, liquid with a suspension of gas bubbles, and mixtures thereof. In the case of the fluid flow conduit 30, nozzle 10, and fluid source 175, the fluid to be transported there through may be selected from the group consisting of liquid, semi-liquid, gel, and mixtures thereof.

In operation, fluid may flow from the fluid source 175 through a single fluid flow conduit 30. At a point where the fluid reaches the fluid flow manifold 90 the fluid may branch into more than one fluid flow conduits 30. The fluid in each fluid flow conduit 30 may flow from each fluid flow conduit 30 into a respective nozzle 10 and is then dispensed. A vacuum may flow from the vacuum source 55 through a single vacuum conduit 50. At a point where the vacuum reaches the vacuum manifold 100 the vacuum may branch into more than one vacuum conduit 50. The vacuum in each vacuum conduit 50 may flow from the vacuum conduit 50 through the vacuum opening 60 to suction residual fluid that may otherwise form a string, drip, or otherwise leave residue within or around the nozzle 10. This residual fluid may flow through the vacuum conduit 50 into a reservoir and may be further used for purposes of re-blend, may be recycled through a separate purification process, or may be discarded. The fluid flow valve 35 controls when fluid first starts to flow from the fluid source 175 into the fluid flow conduit 30. The vacuum valve 70 controls when a vacuum starts to flow from the vacuum source 55 into the vacuum conduit 50.

Figure 2:
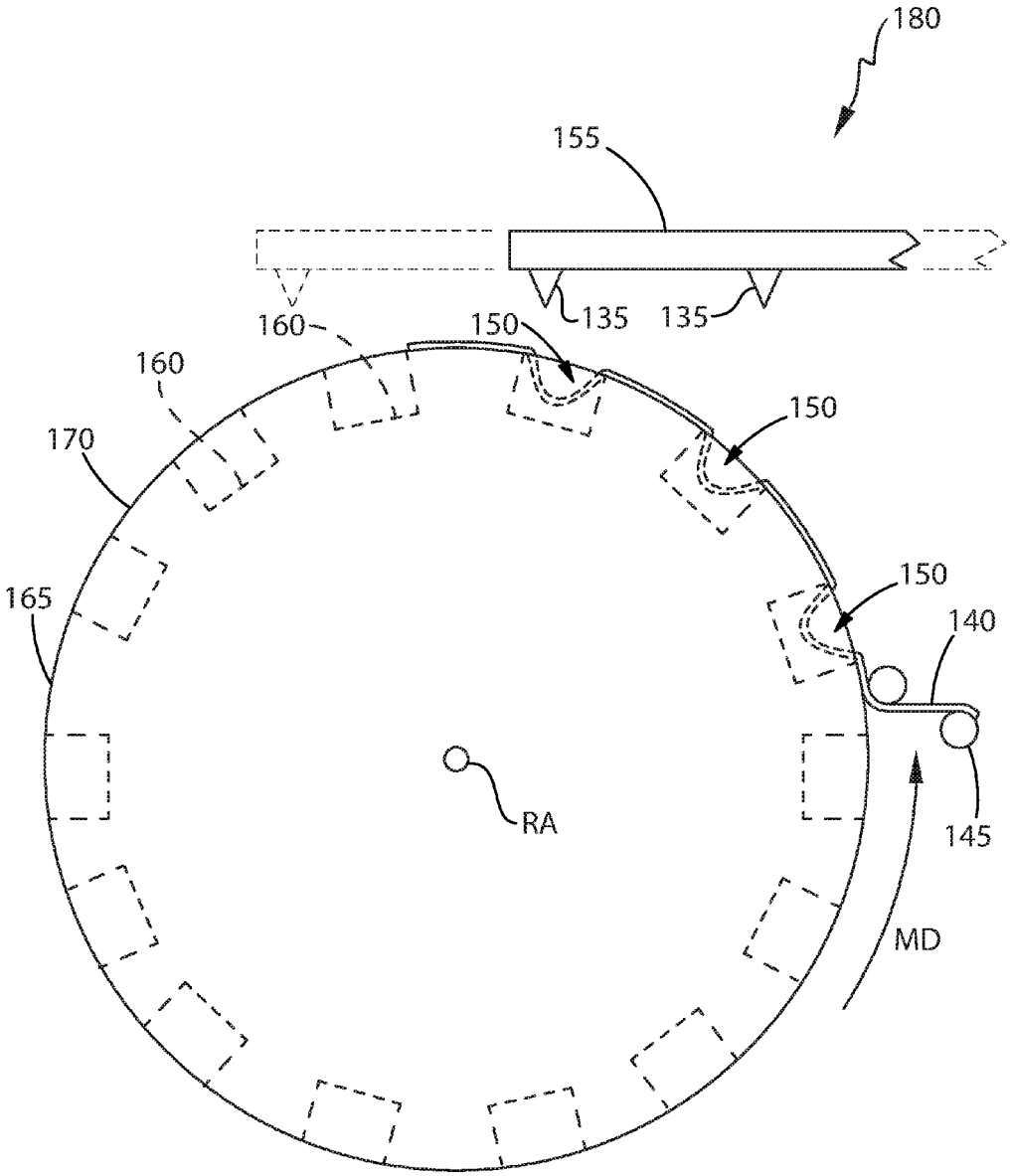
FIG. 2 is a side view of a rotary drum with a portion of a fluid filling assembly displaying the process of using the fluid filling assembly.

FIG. 2 is a side view of a rotary drum 165 with a portion of a fluid filling assembly 180 displaying the process of using the fluid filling assembly 180 encompassing the vacuum assisted nozzle apparatus 135.

The rotary drum 165 may rotate in the machine direction MD about a rotational axis RA. The rotary drum 165 may have a surface 170 positioned radially outward from the rotational axis RA. Rotary drums are described in U.S. Pat. No. 3,057,127. A plurality of molds 160 may be disposed on the surface 170 of the rotary drum 165. A web 140 may be fed from a roll 145 onto the surface 170 of the rotary drum 165 and drawn into the molds 160 by a vacuum applied to the face of the mold 160, forming a plurality of compartments 150. In the non-limiting illustration shown, the compartments 150 are cavities that are circumferentially spaced and aligned to form a lane in the machine direction MD.

The fluid filling assembly 180 may encompass one or more vacuum assisted nozzle apparatus 135 mounted on a shuttle 155. Each vacuum assisted nozzle apparatus 135 may comprise a plurality of nozzles 10 that are each positioned above one or more of the compartments 150 ready to dispense a composition into the compartment 150. The shuttle 155 may start at a first position. The shuttle 155 may systematically move in concert with the rotary drum 165 or a horizontal conveyor belt to align each nozzle 10 with a respective compartment 150 for dispensing of fluid into a compartment 150 during a single filling cycle. After the dispensing of fluid in a single filling cycle, the shuttle 155 may return to the first position in a reciprocating fashion, moving in a direction opposite to the machine direction MD, to prepare for the next filling cycle if a rotary drum 165 is employed. Fluid is typically dispensed into the compartments 150 on a substantially horizontal portion of the rotary drum 165, e.g., when the compartments 150 are at or near the top of the rotary drum 165. The filled compartments 150 may continue to move along the machine direction MD to later be covered by a second web.

Figure 3:
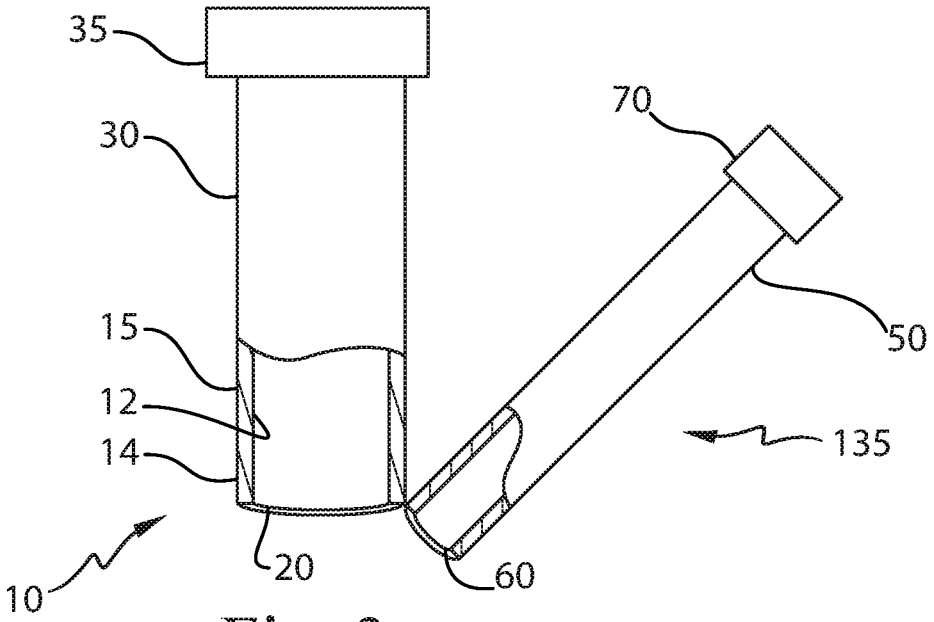
FIG. 3 is a partial cross-sectional side view of a vacuum assisted nozzle apparatus.

FIG. 3 is a partial cross-sectional side view of a non-limiting example of a vacuum assisted nozzle apparatus 135. The vacuum assisted nozzle apparatus 135 may comprise a nozzle 10, a fluid flow conduit 30, a fluid flow valve 35, a vacuum conduit 50, and a vacuum valve 70. The nozzle 10 may comprise a nozzle inlet 15 and a fluid flow discharge opening 20. The fluid flow discharge opening 20 may be in fluid communication with the nozzle inlet 15. The fluid flow discharge opening 20 may have a fluid flow discharge opening area. The fluid flow conduit 30 may be in fluid communication with the nozzle inlet 15 and a fluid source 175. The fluid flow valve 35 may be in line with the fluid flow conduit 30. The fluid flow valve 35 may have a fluid flow valve open position and a fluid flow valve closed position. The vacuum conduit 50 may be in fluid communication with a vacuum source 55. The vacuum conduit 50 may comprise a vacuum opening 60. The vacuum opening 60 may be spatially proximate to the fluid flow discharge opening 20. The vacuum opening 60 may have a vacuum opening area. The vacuum opening area to the fluid flow discharge opening area may have a ratio of less than or equal to 1. The vacuum valve 70 may be in line with the vacuum conduit 50. The vacuum valve 70 may have a vacuum valve open position and a vacuum valve closed position. The components of the apparatus are described in more detail below.

In simple form, the vacuum assisted nozzle apparatus 135 may comprise a nozzle 10 having a fluid flow discharge opening 20 having a fluid flow discharge opening area, and a vacuum opening 60 having a vacuum opening area, wherein the vacuum opening area to the fluid flow discharge opening area may have a ratio of less than or equal to 1. The vacuum opening 60 may be operatively coupled with the nozzle 10 to provide suction.

Alternatively stated, the vacuum assisted nozzle apparatus 135 may provide a fluid flow system and a vacuum system wherein the fluid flow system and vacuum system each alternatively transition back and forth between on and off to have a single filling cycle.

Nozzle

The vacuum assisted nozzle apparatus 135 may comprise a nozzle 10. A variety of configurations for the nozzle 10 may be suitable depending on the application. In a simple form, the nozzle 10 may comprise a nozzle inlet 15 and a fluid flow discharge opening 20. The fluid flow discharge opening 20 may be in fluid communication with the nozzle inlet 15. The fluid flow discharge opening 20 may have a fluid flow discharge opening area.

The nozzle 10 may be any instrument, often a pipe or tube of varying cross-sectional area, designed to direct or modify the flow, such as the speed, direction, mass, shape, and pressure, of a fluid upon exit of the nozzle 10.

The nozzle inlet 15 may be any opening where fluid may flow into the nozzle 10. The nozzle inlet 15 may be of any suitable shape to conduct fluid and is not limited to the embodiments shown. The nozzle inlet 15 has a cross-sectional area. The cross-sectional area of the nozzle inlet 15 may be dependent upon the rheological properties of the fluid being dispensed.

The fluid flow discharge opening 20 may be any opening where fluid flows out from the nozzle 10. The fluid flow discharge opening 20 may be of any suitable shape to conduct fluid and is not limited to the embodiments shown. The fluid flow discharge opening 20 may have an outward facing surface and an inward facing surface. The fluid flow discharge opening 20 may be void of any surface.

The nozzle inlet 15 may be in fluid communication with the fluid flow discharge opening 20. In some embodiments, the nozzle inlet 15 and the fluid flow discharge opening 20 may be in a substantially parallel relationship. In other embodiments, the nozzle inlet 15 may be positioned at a slope relative to the fluid flow discharge opening 20. The location of the nozzle inlet 15 relative to the fluid flow discharge opening 20 is not limited to the embodiments shown and may be of any suitable configuration to conduct fluid flow.

The nozzle inlet 15 is located at a distance from the fluid flow discharge opening 20. This distance may be any suitable distance to conduct fluid. This distance may be between 0 mm and about 300 mm. This distance may be between about 5 mm and about 100 mm, for example, specifically reciting all 0.1 mm increments within the specified ranges and all ranges formed therein or thereby.

The fluid flow discharge opening 20 may have a fluid flow discharge opening area. The fluid flow discharge opening area is a measurement of the cross-sectional area of the fluid flow discharge opening 20 measured at the fluid flow discharge opening 20. The fluid flow discharge opening area may have a circular cross-section as shown in FIG. 3, however, one of skill in the art will recognize that the shape of the cross-section is not so limited. Other suitable cross-section shapes may include but are not limited to ellipses, rectangles, triangles, and horseshoes. The fluid flow discharge opening area may be between about 3 $mm^2$ and about 350 $mm^2$, for example, specifically reciting all 0.1 $mm^2$ increments within the specified ranges and all ranges formed therein or thereby.

The nozzle 10 may be of any shape as known in the art to conduct fluid. In one embodiment, the nozzle 10 may have a cylindrical shape. The nozzle 10 may have a nozzle outer surface 14 and a nozzle inner surface 12 to form a wall of the nozzle 10. The nozzle outer surface 14 and nozzle inner surface 12 may be separated by a distance that may be known as the thickness. The thickness may vary about the length of the nozzle 10. In one embodiment, when the thickness is the same throughout the length of the nozzle, the nozzle outer surface 14 and nozzle inner surface 12 may be said to be in a substantially parallel relationship. The diameter of the nozzle inner surface 12 at the nozzle inlet 15 may be the same diameter of the nozzle inner surface 12 at the fluid flow discharge opening 20. The diameter of the nozzle inner surface 12 at the nozzle inlet 15 may be a different diameter of the nozzle inner surface 12 at the fluid flow discharge opening 20. In one embodiment, the diameter of the nozzle inner surface 12 at the nozzle inlet 15 may be about 4 mm and the diameter of the nozzle inner surface 12 at the fluid flow discharge opening may be about 4 mm. In another embodiment, the diameter of the nozzle inner surface 12 at the nozzle inlet 15 may be about 5 mm and the diameter of the nozzle inner surface 12 at the fluid flow discharge opening may be about 4 mm, for example, specifically reciting all 0.1 mm increments within the specified ranges and all ranges formed therein or thereby.

Figure 4:
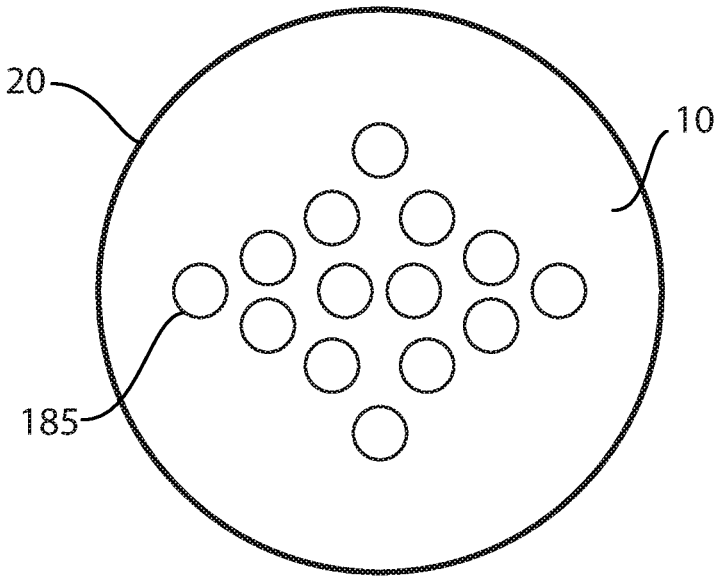
FIG. 4 is a plan view of the surface of the fluid flow discharge opening of a nozzle having a plurality of spaced passageways.

As shown in FIG. 4, the nozzle 10 may have a plurality of spaced passageways 185 that extend through the optional inward facing surface and optional outward facing surface of the fluid flow discharge opening 20 of the nozzle 10. The passageways 185 may form a plurality of apertures. It should be understood that in instances when the nozzle 10 comprises the passageways 185, the nozzle 10 still has features that correspond to those described herein for the nozzle 10. In such circumstances, the diameter of the vacuum opening 60 may be less than the diameter of the nozzle 10 measured at the nozzle inner surface 12.

The nozzle 10 may be made of any suitable material as known in the art. Such materials may include, but are not limited to, stainless steel, titanium, metal alloys, aluminum, plastic, polymers, hardened resins, or polytetrafluoroethylene (e.g., Teflon®) material.

Fluid Flow Conduit

The vacuum assisted nozzle apparatus 135 may further comprise a fluid flow conduit 30. The fluid flow conduit 30 may be in fluid communication with the nozzle inlet 15. The fluid flow conduit 30 may be in fluid communication with a fluid source 175. In an embodiment, the fluid flow conduit 30 may be in fluid communication at a first end with a fluid source 175 and may be in fluid communication at a second end with the nozzle inlet 15. In such embodiment, fluid may flow from the fluid source 175 into the fluid flow conduit 30 first end, flow through the fluid flow conduit 30, flow out of the fluid flow conduit 30 by exiting through the fluid flow conduit 30 second end, then flow into the nozzle inlet 15. In operation, the fluid flow conduit 30 provides a pathway for fluid to flow from a fluid source 175 into the nozzle 10.

The fluid flow conduit 30 may be of any suitable shape to conduct fluid and is not limited to the embodiments shown. In one embodiment, the fluid flow conduit 30 may be of a cylindrical shape. The shape of the fluid flow conduit 30 may be dependent upon the rheological properties of the fluid being dispensed, the spatial constraints of the surrounding machinery, and/or other considerations.

The fluid flow conduit 30 may be of a certain length. The length of the fluid flow conduit 30 may be dependent upon the rheological properties of the fluid being dispensed, the spatial constraints of the surrounding machinery, and/or other considerations.

The fluid flow conduit 30 may have a certain cross-sectional area. The cross-sectional area may vary along its length. The cross-sectional area of the fluid flow conduit 30 may be dependent upon the rheological properties of the fluid being dispensed, the spatial constraints of the surrounding machinery, and/or other considerations.

The fluid flow conduit 30 may be made of any suitable material as known in the art. Such materials may include, but are not limited to, stainless steel, titanium, metal alloys, aluminum, plastic, polymers, hardened resins, or polytetrafluoroethylene (e.g., Teflon®) material.

The fluid flow conduit 30 may be of any suitable shape, length, cross-sectional area, and material suitable to conduct fluids that may include but are not limited to detergent compositions such as those sold under the tradenames TIDE, GAIN, ARIEL, TIDE PODS, GAIN FLINGS, FAIRY and CASCADE manufactured by The Procter & Gamble Company, Cincinnati, Ohio, USA.

Fluid Flow Valve

The vacuum assisted nozzle apparatus 135 may further comprise a fluid flow valve 35. The fluid flow valve 35 may be in line with the fluid flow conduit 30. The fluid flow valve 35 may have a fluid flow valve open position and a fluid flow valve closed position. The fluid flow valve 35 may be any such suitable instrument known by one skilled in the art that may alter the fluid flow. In operation, the fluid flow valve 35 regulates the flow of fluid into the fluid flow conduit 30 by allowing for fluid to flow into the fluid flow conduit 30 when the fluid flow valve 35 is in the fluid flow valve open position and halting or restricting fluid from flowing into the fluid flow conduit 30 when the fluid flow valve 35 is in the fluid flow valve 35 closed position. The fluid flow valve 35 may be by way of non-limiting example a valve selected from the group consisting of ball valve, a butterfly valve, a piston valve, a membrane valve, a plunger valve, a spool valve, a pinch valve, solenoid valve and a gate valve.

The fluid flow valve 35 may have a fluid flow valve open position. The fluid flow valve open position may be a position in which the fluid flow valve 35 permits fluid to flow through the fluid flow conduit 30. The fluid flow valve 35 may further have a fluid flow valve closed position. The fluid flow valve closed position may be where the fluid flow valve 35 restricts or halts fluid from flowing through the fluid flow conduit 30.

Vacuum Conduit

The vacuum assisted nozzle apparatus 135 may further comprise a vacuum conduit 50 in fluid communication with a vacuum source 55. The vacuum conduit 50 may comprise a vacuum opening 60. The vacuum opening 60 may be spatially proximate to the fluid flow discharge opening 20. The vacuum opening 60 may have a vacuum opening area. The vacuum opening area to the fluid flow discharge opening area may have a ratio of less than or equal to 1.

The vacuum conduit 50 may be in fluid communication with a vacuum source 55 to draw a vacuum into the vacuum conduit 50. In operation, the vacuum conduit 50 provides for a vacuum to suction the residual fluid dispensed from the fluid flow discharge opening 20 into the vacuum conduit 50 to prevent stringing and dripping on the fluid flow discharge opening 20.

The location of the vacuum opening 60 relative to the fluid flow discharge opening 20 is further described hereinafter. More than one vacuum conduit 50 may be joined to one nozzle 10. The vacuum opening 60 may have a vacuum opening area. The vacuum opening area is a measurement of the cross-sectional area of the vacuum opening 60 measured at the inward facing surface of the vacuum opening 60. The vacuum opening area may have a circular cross-section as shown in FIG. 3, however, one of skill in the art will recognize that the shape of the cross-section is not so limited. Other suitable cross-section shapes may include but are not limited to ellipses, rectangles, triangles, and horseshoes. The vacuum opening area may be between about 1 $mm^2$ and about 300 $mm^2$, for example, specifically reciting all 0.1 $mm^2$ increments within the specified ranges and all ranges formed therein or thereby. In operation, the vacuum opening 60 may allow for a string or drip of residual fluid dispensed from the fluid flow discharge opening 20 to be sucked up into the vacuum conduit 50 and prevent such material from fouling the compound filling process. The vacuum conduit 50 may be of any suitable shape to known to one skilled in the art and is not limited to the embodiments shown. In one embodiment, the vacuum conduit 50 may have a circular cross-section. The shape of the vacuum conduit 50 may be dependent upon the rheological properties of the residual fluid being dispensed through the fluid flow discharge opening 20 and then suctioned through the vacuum conduit 50, the spatial constraints of the surrounding machinery, and/or other considerations.

The vacuum conduit 50 may be of a certain length. The length of the vacuum conduit 50 may be dependent upon the rheological properties of the residual fluid being dispensed through the fluid flow discharge opening 20 and then suctioned through the vacuum conduit 50, the spatial constraints of the surrounding machinery, and/or other considerations.

The vacuum conduit 50 may have a certain cross-sectional area. The cross-sectional area may vary along its length. The cross-sectional area of the vacuum conduit 50 may be dependent upon the spatial constraints of the surrounding machinery, and/or other considerations.

The vacuum opening area to the fluid flow discharge opening area may have a ratio of less than or equal to 1. The vacuum opening area to the fluid flow discharge opening area ratio may be calculated by dividing the measurement of the vacuum opening area by the measurement of the fluid flow discharge opening area. The vacuum opening area to the fluid flow discharge opening area may have a ratio of between about 0.1 and 1. The vacuum opening area to the fluid flow discharge opening area may have a ratio of between about 0.2 and about 0.9. The vacuum opening area to the fluid flow discharge opening area may have a ratio of between about 0.4 and about 0.7, for example, specifically reciting all 0.1 increments within the specified ranges and all ranges formed therein or thereby. The vacuum opening area may be less than or equal to the fluid flow discharge opening area. The vacuum opening area to the fluid flow discharge opening area having a ratio of less than or equal to 1 provides greater efficiency of the vacuum in suctioning fluid from the fluid flow discharge opening 20 because, without wishing to be bound by theory, as the diameter of a pipe increases, the velocity of the fluid flowing through the pipe decreases. Here, as the vacuum opening area increases, the velocity of the air in the vacuum decreases, resulting in decreased suction, which is unfavorable and inefficient. Conversely, as the vacuum opening area decreases, the velocity of the air in the vacuum increase, resulting in increased suction, which provides greater efficiency in suctioning fluid from the fluid flow discharge opening 20. The vacuum opening area to the fluid flow discharge opening area having a ratio of less than or equal to 1, or, alternatively said, the vacuum opening area being less than or equal to the fluid flow discharge opening area provides the additional benefit of taking up a smaller space in an already compact and crowded space.

Vacuum Valve

The vacuum assisted nozzle apparatus 135 may further comprise a vacuum valve 70. The vacuum valve 70 may be in line with the vacuum conduit 50. The vacuum valve 70 may have a vacuum valve open position, and a vacuum valve closed position. In operation, the vacuum valve 70 regulates the flow of vacuum through the vacuum conduit 50 by allowing for application of vacuum at the vacuum opening 60 when the vacuum valve 70 is in the vacuum valve open position and halting or restricting application of vacuum at the vacuum opening 60 when the vacuum valve 70 is in the vacuum valve closed position.

The vacuum valve 70 may be in line with the vacuum conduit 50. The vacuum valve 70 may be by way of non-limiting example a valve selected from the group consisting of ball valve, a butterfly valve, a piston valve, a membrane valve, a plunger valve, a spool valve, a pinch valve, a solenoid valve, and a gate valve.

The vacuum valve 70 may have a vacuum valve open position. In the vacuum valve open position, a vacuum can be applied to the vacuum opening 60. When the vacuum valve 60 is in the vacuum valve open position, the vacuum applied to the vacuum valve opening 60 can suck residual fluid into the vacuum opening 60. The vacuum valve 70 may have a vacuum valve closed position where the vacuum may not be applied to the vacuum opening 60. Where the vacuum valve 70 is in the vacuum valve closed position, suction of fluid into the vacuum opening 60 may not be occurring.

In a single filling cycle the vacuum valve 70 may transition from the vacuum valve closed position to the vacuum valve open position before the fluid flow valve 35 may transition from the fluid flow valve open position to the fluid flow valve closed position. In other words, the fluid flow valve 35 and the vacuum valve 70 may be coupled so that the fluid flow valve 35 may be in the fluid flow valve closed position after the vacuum valve 70 may be in the vacuum valve open position in a single filling cycle. Coupling is further described herein.

Proximity of Vacuum Opening to Fluid Flow Discharge Opening

The vacuum opening 60 may be spatially proximate to the fluid flow discharge opening 20. The fluid flow discharge opening 20 may be any opening where fluid flows out from the nozzle 10. The fluid flow discharge opening 20 may be of any suitable shape to conduct fluid and is not limited to the embodiments shown.

The vacuum opening 60 and the fluid flow discharge opening 20 may be separated by 0 mm to about 100 mm. The vacuum opening 60 and the fluid flow discharge opening 20 may be separated by 0 mm to about 60 mm. The vacuum opening 60 and the fluid flow discharge opening 20 may be separated by 0 mm to about 40 mm, for example, specifically reciting all 0.1 mm increments within the specified ranges and all ranges formed therein or thereby. The vacuum opening 60 and the fluid flow discharge opening 20 may be separated by any suitable distance that allows for the vacuum assisted nozzle apparatus 135 to deliver its intended benefits. The vacuum opening 60 may be located closer to the fluid flow discharge opening 20 than to the nozzle inlet 15. The vacuum opening 60 may be located closer to the nozzle inlet 15 than to the fluid flow discharge opening 20. The separation distance is measured from the closer edge of the vacuum opening 60 to the closer edge of the fluid flow discharge opening 20.

Figure 6:
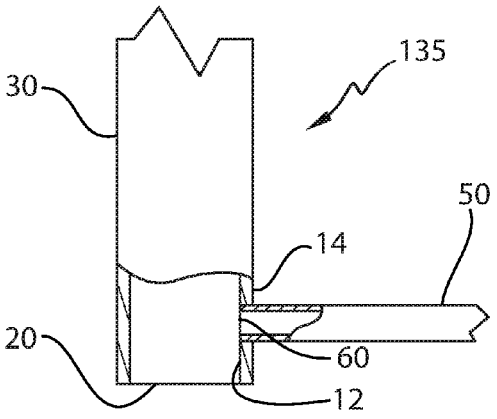
FIG. 6 is a partial cross-sectional side view of an embodiment of the vacuum assisted nozzle apparatus.
Figure 5:
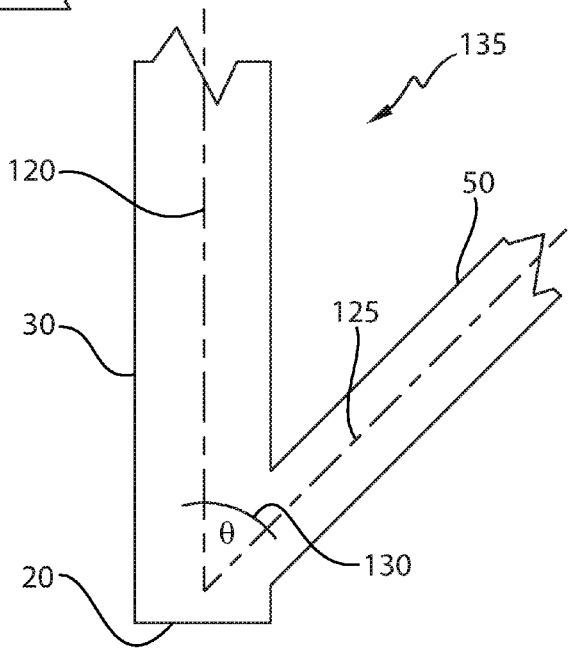
FIG. 5 is a side view of a vacuum assisted nozzle apparatus showing the included angle.
Figure 7:
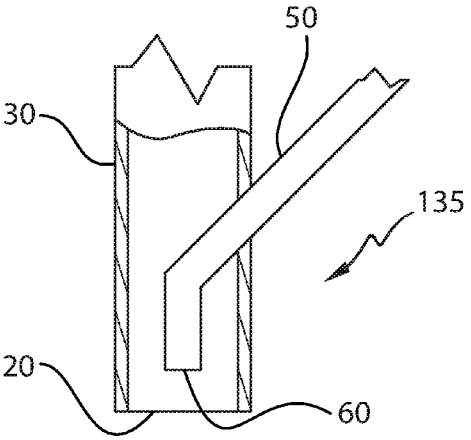
FIG. 7 is a partial cross-sectional side view of an embodiment of the vacuum assisted nozzle apparatus.

FIGS. 5-7 are cross-sectional side views of non-limiting embodiments of the vacuum assisted nozzle apparatus 135. As shown in FIG. 5, the fluid flow conduit 30 has a fluid flow conduit axis 120 in line with a direction of fluid flow. As further shown in FIG. 5, the vacuum conduit 50 has a vacuum conduit axis 125 in line with a direction of vacuum flow. As further shown in FIG. 5, the fluid flow conduit axis 120 and the vacuum conduit axis 125 may define an included angle there between. In one embodiment, the included angle may be less than 90 degrees. In an alternative embodiment, the included angle may be greater than 90 degrees. In an alternative embodiment, the included angle may be from about 20 degrees to less than 90 degrees. In an alternative embodiment, the included angle may be about 30 degrees.

The nozzle 10 may comprise a nozzle outer surface 14 and a nozzle inner surface 12. As shown in a non-limiting embodiment in FIG. 6, the vacuum opening 60 may be coincident with the nozzle inner surface 12. As further shown in a non-limiting embodiment in FIG. 6, the vacuum opening 60 may be approximately orthogonal to the fluid flow discharge opening 20. As shown in a non-limiting embodiment in FIG. 7, the vacuum opening 60 may be located within the fluid flow conduit 30. As further shown in a non-limiting embodiment in FIG. 7, the vacuum conduit 50 may be partially located within the fluid flow conduit 30. As further shown in a non-limiting embodiment in FIG. 7, the vacuum opening 60 may be approximately parallel to the fluid flow discharge opening 20.

There may be more than one vacuum opening 60 spatially proximate to one fluid flow discharge opening 20.

Manifolds

In an alternative embodiment, the vacuum assisted nozzle apparatus 135 may comprise a plurality of nozzles 10, a plurality of fluid conduits 30, and a plurality of vacuum conduits 50. In such an embodiment as shown in FIG. 1, the vacuum assisted nozzle apparatus 135 may further comprise a fluid flow manifold 90 and a vacuum manifold 100. The fluid flow manifold 90 may be in line with the plurality of fluid flow conduits 30 between the fluid flow valve 35 and the plurality of nozzles 10. The plurality of fluid flow conduits 30 may be in fluid communication with a fluid source 175. The fluid flow valve 35 may reside between the plurality of fluid flow conduits 30 and the fluid source 175. The fluid flow manifold 90 may be in fluid communication with the plurality of nozzles 10. In operation, the fluid flow manifold 90 may be a pipe or a chamber that branches into several openings to allow for fluid to flow from a fluid source 175 through the plurality of fluid flow conduits 30. The vacuum manifold 100 may be in line with the plurality of vacuum conduits 50 between the vacuum valve 70 and the vacuum opening 60. The plurality of vacuum conduits 50 may be in fluid communication with a vacuum source 55. The vacuum valve 70 may reside between the plurality of vacuum conduits 50 and the vacuum source 55. The vacuum manifold 100 may be in fluid communication with the plurality of vacuum conduits 50. In operation, the vacuum manifold 100 may be a pipe or chamber that branches into several openings to allow for the vacuum to flow from a vacuum source 55 through the plurality of vacuum conduits 50. In a multiple nozzle apparatus, the plurality of nozzles 10 are according to the present invention.

In operation, fluid may flow from the fluid source 175 through a single fluid flow conduit 30. At a point where the fluid reaches the fluid flow manifold 90 the fluid may branch into more than one fluid flow conduits 30. The fluid in each fluid flow conduit 30 may flow from each fluid flow conduit 30 into a respective nozzle 10 and is then dispensed. A vacuum may flow from the vacuum source 55 through a single vacuum conduit 50. At a point where the vacuum reaches the vacuum manifold 100 the vacuum may branch into more than one vacuum conduit 50. The vacuum in each vacuum conduit 50 may flow from the vacuum conduit 50 through the vacuum opening 60 to suction residual fluid that may otherwise form a string, drip, or otherwise leave residue within or around the nozzle 10.

The fluid flow manifold 90 may be any instrument known to one skilled in the art to facilitate the branching of fluid into the plurality of fluid flow conduits 30. The fluid flow manifold 90 may have as many openings as needed. The vacuum manifold 100 may be any instrument known to one skilled in the art to facilitate the branching of vacuum into the plurality of vacuum conduits 50. The vacuum manifold 100 may have as many openings as needed.

In such an embodiment, the vacuum assisted nozzle apparatus 135 may comprise more than one vacuum conduit 50 per individual nozzle 10 to better facilitate vacuum suction. The vacuum assisted nozzle apparatus 135 may have more than one vacuum opening 60 spatially proximate to one fluid flow discharge opening 20 to better facilitate suction of a fluid string, drip, or residual fluid in the nozzle 10.

Having a fluid flow manifold 90 and a vacuum manifold 100 may be beneficial in operations where there are multiple filling lanes, such as on a horizontal conveyor belt or on a rotary drum 165. For example, as shown in FIG. 2, there may be a rotary drum 165 with multiple compartments 150 that need to be filled. In the non-limiting example shown in FIG. 2, there may be one or more individual vacuum assisted nozzle apparatus 135 located on a single shuttle 155. Each of the individual vacuum assisted nozzle apparatus 135 may fill a separate compartment 150 at the same time to increase the number of compartments 150 that can be filled in a given increment of time. The fluid flow manifold 90 may allow for fluid to flow from one fluid source 175 and branch into the three vacuum assisted nozzle apparatus 135 through the fluid flow conduit 30. The vacuum manifold 100 may allow for the vacuum to flow from one vacuum source 55 and branch into the three vacuum assisted nozzle apparatus 135 through the vacuum conduit 50. In addition to the time saving productivity benefit of allowing for more compartments 150 to be filled at the same time, the fluid flow manifold 90 and vacuum manifold 100 allow for the benefit of saving space where there only needs to be one fluid source 175 and one vacuum source 55 for a plurality of vacuum assisted nozzle apparatus 135.

Process

The present invention encompasses a process of dispensing fluid using the apparatus according to the present invention. The vacuum assisted nozzle apparatus 135 may be used to dispense fluid as described herein. In some aspects, the process may comprise the steps of: providing a vacuum assisted nozzle apparatus 135 wherein the vacuum assisted nozzle apparatus 135 comprises a nozzle 10 wherein the nozzle comprises a fluid flow discharge opening 20; dispensing fluid from the fluid flow discharge opening 20; and applying a vacuum while the fluid is dispensed. The nozzle 10 can further comprise a nozzle inlet 15 in fluid communication with the fluid flow discharge opening 20. The vacuum assisted nozzle apparatus 135 may further comprise a fluid flow conduit 30 in fluid communication with the nozzle inlet 15 and a fluid flow valve 35 in line with the fluid flow conduit 30, wherein the fluid flow valve 35 may have a fluid flow valve open position and a fluid flow valve closed position. The vacuum assisted nozzle apparatus may further comprise a vacuum conduit 50 in fluid communication with a vacuum source 55 wherein the vacuum conduit 50 may comprise a vacuum opening 60 wherein the vacuum opening 60 is spatially proximate to the fluid flow discharge opening 20. The vacuum assisted nozzle apparatus 135 may further comprise a vacuum valve 70 in line with the vacuum conduit 50, wherein the vacuum valve 70 may have a vacuum valve open position and a vacuum valve closed position. The fluid flow valve 35 and the vacuum valve 70 may be coupled.

The process may further comprise the step of placing the fluid flow valve 35 in the fluid flow valve open position before the step of dispensing fluid from the fluid flow discharge opening 20 in a single filling cycle. Fluid may be dispensed by a pump. Fluid may be dispensed gravitationally. Fluid may be dispensed by any means known to one skilled in the art to facilitate the dispensing of fluid from the fluid flow discharge opening 20 into a compartment 150. When the fluid flow valve 35 is in the fluid flow valve open position, fluid may flow into the fluid flow conduit 30 from the fluid source 175. Placing the fluid flow valve 35 in the fluid flow valve open position may allow for fluid to flow into the fluid flow conduit 30, through the fluid flow conduit 30 into the nozzle 10, and be dispensed into a compartment 150 below the vacuum assisted nozzle apparatus 135.

A single filling cycle can be thought of as follows. First, the fluid flow valve 35 is opened. Fluid flows through the fluid flow conduit 30 into the nozzle 10. Over time, fluid flow through the nozzle 10 develops. Fluid is dispensed from the nozzle 10 for a desired increment of time. The trailing quantity of fluid between the fluid flow valve 35 and the fluid flow discharge opening 20 is dispensed. At a desired time, the vacuum valve 70 is opened. Vacuum develops in the vacuum conduit 50. Proximate in time to the vacuum valve 70 being opened, the fluid flow valve 35 is closed. The vacuum then suctions the residual fluid from the fluid flow discharge opening 20 to remove any string filament, dripping, or residue. The vacuum valve 70 then closes. Alternatively, a single filling cycle may be described by a singular transition of the vacuum valve 70 from the vacuum valve closed position to the vacuum valve open position and a singular transition of the fluid flow valve 35 from the fluid flow valve open position to the fluid flow valve closed position.

The process may comprise the step of placing the vacuum valve 70 in the vacuum valve open position while the fluid is dispensed from the fluid flow discharge opening 20. By keeping the vacuum valve 70 in the vacuum valve open position while fluid is dispensed from the fluid flow discharge opening 20, any stringing may be removed before the nozzle 10 moves. Without the vacuum valve 70 in the vacuum valve open position, residual fluid may string together, drip, and/or become residue on the nozzle 10.

The process may further comprise the step of placing the vacuum valve 70 in the vacuum valve open position before placing the fluid flow valve 35 in the fluid flow valve closed position. The benefit of placing the vacuum valve 70 in the vacuum valve open position before the step of placing the fluid flow valve 35 in the fluid flow valve closed position is that this order can provide for more accurate dosing to account for the amount of time taken between when the vacuum valve 70 is in the vacuum valve open position and when the fluid flow valve is in the fluid flow valve closed position, due to the residual fluid from the fluid source 175 that still flows through the fluid flow conduit 30 after the fluid flow valve 35 is in the fluid flow valve closed position.

In a single filling cycle the vacuum valve 70 may transition from the vacuum valve closed position to the vacuum valve open position before the fluid flow valve 35 may transition from the fluid flow valve open position to the fluid flow valve closed position. In other words, the fluid flow valve 35 and the vacuum valve 70 may be coupled so that the vacuum valve 70 is in the vacuum valve open position before the fluid flow valve 35 is in the fluid flow valve closed position in a single filling cycle. In operation, the fluid flow valve 35 and the vacuum valve 70 can be coupled in so that the functioning of each valve is linked to the other so that the change in position of one valve may be associated with a change in the position of the other valve. The fluid flow valve 35 and the vacuum valve 70 may be coupled by any means known to one skilled in the art. The fluid flow valve 35 and vacuum valve 70 may be mechanically coupled. The fluid flow valve 35 and the vacuum valve 70 may be electronically coupled. The fluid flow valve 35 and the vacuum valve 70 may be manually coupled. The fluid flow valve 35 and the vacuum valve 70 may be coupled by a programmable logic controller. The fluid flow valve 35 and the vacuum valve 70 may be coupled by a coupling element 190. The coupling element 190 may be electromechanical. The coupling element 190 may be mechanical. The coupling element 190 may be electrical. The coupling element 190 may be any instrument to known to one skilled in the art used for automation of processes and is not limited to the examples described. The coupling element 190 may be operatively connected to both the fluid flow valve 35 and to the vacuum valve 75. The coupling element 190 may be connected to the fluid flow valve 35 and to the vacuum valve 75 by a coupling connector connected to the coupling element 190 and to the fluid flow valve 35 and further connected to the coupling element 190 and to the vacuum valve 70. The coupling connecter may be by way of non-limiting example a coupling connector selected from the group consisting of a signal cable, a wire, an electronic signal, a cable, a fiber optic cable, a communication cable, and combinations thereof. The amount of set time chosen between when the vacuum valve 70 is in the vacuum valve open position and when the fluid flow valve 35 is in the fluid flow valve closed position may depend upon, but is not limited to, the rheological properties of the fluid, the geometry of the vacuum assisted nozzle apparatus 135, and the time response due to any inertia, including but not limited to mechanical inertia and fluid inertia, both fluid in the nozzle 10 and application of the vacuum. In operation, when the vacuum valve 70 changes from the vacuum valve closed position to the vacuum valve open position, the coupling mechanism causes the fluid flow valve 35 to change from the fluid flow valve open position to the fluid flow valve closed position at a set time thereafter. For example, in the dispensing of small amounts of fluid such as several milliliters, the fluid flow valve 35 will move to the fluid flow valve closed position only a few milliseconds after the vacuum valve 70 moves to the vacuum valve open position.

The process may further comprise the step of placing the vacuum valve 70 in the vacuum valve closed position as the fluid approaches a dosing amplitude of 0 mm. At a dosing amplitude of 0 mm, fluid is not stringing and the dosing of a single filling cycle is complete. When the fluid flow valve 35 is in the fluid flow valve closed position, further fluid flow from the fluid source 175 is shut off, however, there may be residual fluid flowing through the fluid flow conduit 30 and through the nozzle 10 and then dispensed from the fluid flow discharge opening 20. As the remaining fluid moves through the fluid flow conduit 30 and through the nozzle 10, the dosing amplitude decreases as the quantity of residual fluid decreases, and eventually the dosing amplitude may approach 0 mm. This residual fluid may string, drip, or leave a residue within the fluid flow conduit 30 and/or within the nozzle 10. The residual fluid may string, drip, or leave a residue around the fluid flow discharge opening 20. The residual fluid may form a filament or string that forms and hangs down from the nozzle 10. This residual filament may take some time to release from the fluid flow discharge opening 20. To reduce dripping and residue stringing, the vacuum valve 70 is placed in the vacuum valve open position while the residual fluid is dispensed from the fluid flow discharge opening 20 and is approaching a dosing amplitude of 0 mm so that the vacuum may suction the residual fluid that has formed a string filament through the vacuum opening 60.

In some aspects, the vacuum assisted nozzle apparatus 135 may dispense the fluid into compartments 150 located below the vacuum assisted nozzle apparatus 135. Suitable compartments 150 may be soluble-unit dose pouches, such as those sold under the tradenames TIDE, GAIN, ARIEL, TIDE PODS, GAIN FLINGS, FAIRY and CASCADE manufactured by The Procter & Gamble Company, Cincinnati, Ohio, USA. In some aspects, the vacuum assisted nozzle apparatus 135 may dispense the fluid into soluble-unit dose pouches located below the vacuum assisted nozzle apparatus 135. The compartments 150 may be selected from the group consisting of thermoformed water-soluble film, water-soluble film, plastic bottles, glass bottles, and soluble-unit dose pouches. The vacuum assisted nozzle apparatus 135 may dispense fluid into compartments 150 on a rotary drum 165. The vacuum assisted nozzle apparatus 135 may dispense fluid into compartments 150 on a horizontal conveyor belt. The quantity of fluid dispensed into a compartment 150 may be between about 0.1 mL and about 100 mL. The quantity of fluid dispensed into a compartment 150 may be between about 1 mL and about 30 mL, for example, specifically reciting all 0.1 mL increments within the specified ranges and all ranges formed therein or thereby. The quantity of fluid dispensed into a compartment 150 may be of any suitable quantity known by one skilled in the art to fill the compartment 150 in use.

The fluid dispensed may have a viscosity from about 10 mPa·s to about 2000 mPa·s measured at 20° C. and at a shear rate of 1000 $s^{-1}$. The fluid dispensed may have a viscosity from about 50 mPa·s to about 1000 mPa·s measured at 20° C. and at a shear rate of 1000 $s^{-1}$. More preferably, the fluid dispensed may have a viscosity from about 100 mPa·s to about 900 mPa·s measured at 20° C. and at a shear rate of 1000 $s^{-1}$. The fluid may be Newtonian or non-Newtonian (shear thinning) fluids. The fluid dispensed may have any suitable viscosity known by one skilled in the art to fill the compartment 150 in use when the fluid is measured at a particular temperature. Viscosity may be measured using a rotational rheometer. Viscosity may be measured at ambient conditions. Suitable fluids may include, but are not limited to, detergent compositions, such as those sold under the tradenames TIDE, GAIN, ARIEL, TIDE PODS, GAIN FLINGS, FAIRY and CASCADE manufactured by The Procter & Gamble Company, Cincinnati, Ohio, USA.

In some aspects, the absolute pressure upstream from the vacuum opening 60 may be between about 10 kPa and about 90 kPa. The absolute pressure upstream from the vacuum opening 60 may be between about 20 kPa and about 80 kPa. The pressure at the vacuum opening 60 may be dependent upon the rheological properties of the fluid being dispensed from the nozzle 10, the quantity of fluid being dispensed from the nozzle 10, the size of the fluid flow discharge opening area, and/or other considerations.

Figure 8:
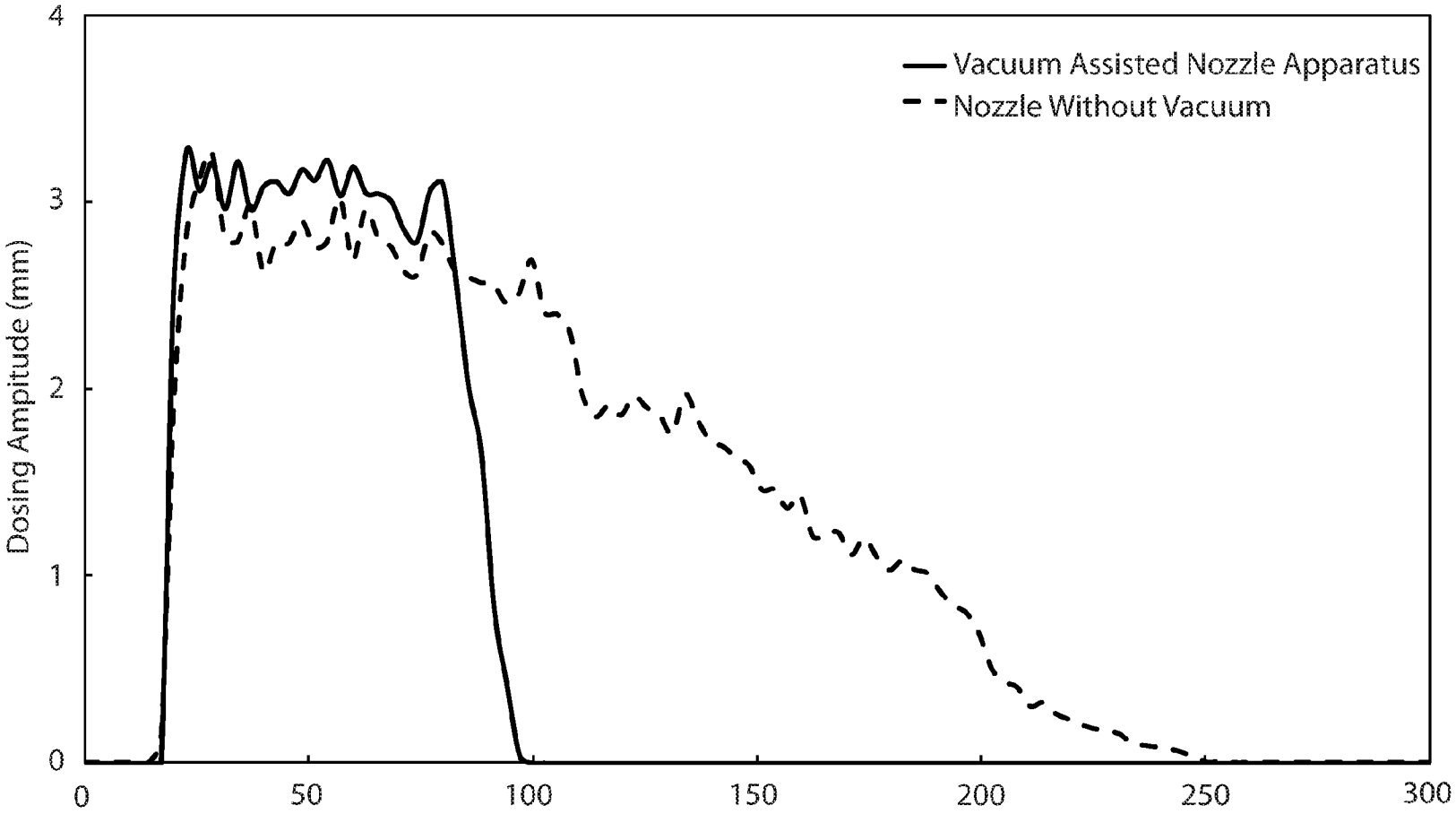
FIG. 8 is a graph of the time taken for fluid dispensed to reach a dosing amplitude of 0 mm in filling a compartment with 1.6 mL of fluid comparing a nozzle without vacuum and the vacuum assisted nozzle apparatus of the present disclosure.

FIG. 8 is a graphical illustration of the time taken for fluid dispensed to reach a dosing amplitude of 0 mm in filling a compartment 150 with 1.6 mL of fluid. The dotted line in FIG. 8 illustrates the dosing amplitude as a function of time when no vacuum is used in conjunction with the nozzle 10, hereinafter nozzle without vacuum. The solid line in FIG. 8 illustrates the dosing amplitude as a function of time when the vacuum assisted nozzle apparatus 135 is employed.

In this test, data from a single filling cycle of 1.6 mL of fluid was collected from the use of a nozzle without vacuum and data from a single filling cycle of 1.6 mL of the same fluid was collected from the use of a vacuum assisted nozzle apparatus 135 to determine the amount of time taken from when the fluid first had a positive dosing amplitude to when the fluid approached a dosing amplitude of 0 mm, which is when the fluid string breaks. Both the nozzle without vacuum and the vacuum assisted nozzle apparatus 135 had a length of 30 mm and had a fluid flow discharge opening area of 6.16 $mm^2$. The vacuum conduit 50 attached to the vacuum assisted nozzle apparatus 135 had a length of 20 mm and had a vacuum opening area of 3.14 $mm^2$. The vacuum source 55 attached to the vacuum assisted nozzle apparatus 135 applied an absolute pressure of 50 kPa upstream from the vacuum opening 60. The included angle defined by the fluid flow conduit axis and vacuum conduit axis was 90 degrees. The fluid dispensed had a viscosity of 500 mPa·s measured at 20° C. and at a shear rate of 1000 $s^{-1}$. The viscosity of the fluid dispensed was measured using a rotational rheometer at ambient conditions. The fluid used was liquid detergent, more specifically, the liquid detergent contained in the marketed TIDE PODS manufactured by The Procter & Gamble Company, Cincinnati, Ohio, USA.

For both the nozzle without vacuum dispensing cycle and the vacuum assisted nozzle apparatus 135 dispensing cycle, the fluid flow valve 35 was placed in the fluid flow valve open position allowing fluid to be dispensed from a fluid source 175. Fluid was dispensed using a pump. For the nozzle without vacuum, the fluid flow valve 35 was placed in the fluid flow valve closed position after 1.6 mL of fluid was dispensed into the compartment 150 below the nozzle without vacuum. For the vacuum assisted nozzle apparatus 135, the vacuum valve 70 was placed in the vacuum valve open position and then the fluid flow valve 35 was placed in the fluid flow valve closed position. For the vacuum assisted nozzle apparatus 135, the vacuum valve 70 and the fluid flow valve 35 were electronically coupled using conventional electronic means using a programmable logic controller (PLC) so that the vacuum valve 70 was placed in the vacuum valve open position with the precise time for the vacuum to manifest itself at the fluid flow discharge opening 20 to allow suction for when 1.6 mL was dispensed into the compartment 150 below the vacuum assisted nozzle apparatus 135.

For both the nozzle without vacuum dispensing cycle and the vacuum assisted nozzle apparatus 135 dispensing cycle, data was recorded of the dosing amplitude as a function of the time until the dosing amplitude was 0 mm. As the fluid flow valve 35 was placed in the fluid flow valve open position and fluid began to flow, a timer was immediately turned on and the fluid exiting the fluid flow discharge opening 20 was recorded using a Mako U-029B high-speed camera from Graftek Imaging, Austin, Tex., USA, with a frame rate of 350 frames per second. Graftek Image software from Graftek Imaging, Austin, Tex., USA, was used to calculate the data using a grayscale of 256 bits. The software played the video in slow motion and measured the dosing amplitude through knowledge of the number of pixels in the image which were calibrated to the diameter stream of the fluid. The recorded points were plotted on a graph as shown. The dosing amplitude was recorded every 2.85 ms.

As shown in FIG. 8, the nozzle without vacuum took about 2.5 times the amount of time to fill a compartment 150 with 1.6 mL of fluid than the vacuum assisted nozzle apparatus 135 of the present disclosure. For the nozzle without vacuum, the time taken for the dosing amplitude to reach 0 mm was about 250 ms. In contrast, for the vacuum assisted nozzle apparatus 135, the time taken for the dosing amplitude to reach 0 mm was about 100 ms. For the nozzle without vacuum, the time taken to reach a dosing amplitude of 0 mm from the final peak on the curve showing dosing amplitude was approximately 150 ms, whereas for the vacuum assisted nozzle apparatus 135, the time taken to reach a dosing amplitude of 0 mm from the final peak on the curve showing dosing amplitude was approximately 20 ms. The results of this test indicate that the vacuum assisted nozzle 135 of the present disclosure provides a great benefit in processes such as filling lines, as it takes significantly less time to fill compartments, allowing for a greater number of compartments 150 to be filled in the same amount of time when compared to a nozzle without vacuum given that the vacuum assisted nozzle apparatus 135 greatly reduces the timing constraint that is attributed to stringing.

This decrease in time taken to reach a dosing amplitude of 0 mm enables a decrease in the amount of time to fill compartments 150. This can correspond in an increase in the number of compartments 150 that can be filled in a given time increment.

For illustration, a single horizontal conveyor belt line filling one compartment 150 at a time with 1.6 mL of fluid using a nozzle without vacuum could fill approximately 345,600 compartments 150 per day, if running constantly for a twenty-four hour period, measured at 250 milliseconds (ms) per filling cycle. A single horizontal conveyor belt line filling one compartment 150 at a time with 1.6 mL of fluid using the vacuum assisted nozzle apparatus 135 could fill approximately 864,000 compartments per day, if running constantly for a twenty-four hour period, measured at 100 ms per filling cycle. The vacuum assisted nozzle apparatus 135 could allow a 250% increase in the productivity for a single lane when compared to a nozzle without vacuum. This reduction in time spent per filling cycle is greatly beneficial for companies like The Procter & Gamble Company, Cincinnati, Ohio, USA, who produce millions of fluid filled compartments, such as soluble-unit dose compartments of those sold under the tradenames TIDE, GAIN, ARIEL, TIDE PODS, GAIN FLINGS, FAIRY and CASCADE manufactured by The Procter & Gamble Company, Cincinnati, Ohio, USA, where time and efficiency on the manufacturing filling line is of the essence.

EXAMPLES/COMBINATIONS

A. An apparatus providing a filling cycle comprising:
a nozzle 10 comprising a nozzle inlet 15 and a fluid flow discharge opening 20 in fluid communication with said nozzle inlet, wherein said fluid flow discharge opening has a fluid flow discharge opening area;
a fluid flow conduit 30 in fluid communication with said nozzle inlet, said fluid flow conduit in fluid communication with a fluid source 175;
a fluid flow valve 35 in line with said fluid flow conduit, wherein said fluid flow valve has a fluid flow valve open position and a fluid flow valve closed position;
a vacuum conduit 50 in fluid communication with a vacuum source 55, said vacuum conduit comprising a vacuum opening 60, wherein said vacuum opening is spatially proximate to said fluid flow discharge opening and wherein said vacuum opening has a vacuum opening area,
and wherein said vacuum opening area to said fluid flow discharge opening area has a ratio of less than or equal to 1, preferably from 0.1 to 1, more preferably from 0.2 and 0.9, most preferably from 0.4 to 0.7;
and a vacuum valve 70 in line with said vacuum conduit, wherein said vacuum valve has a vacuum valve open position and a vacuum valve closed position.

B. The apparatus according to paragraph A, wherein in a single filling cycle said vacuum valve transitions from said vacuum valve closed position to said vacuum valve open position before said fluid flow valve transitions from said fluid flow valve open position to said fluid flow valve closed position.

C. The apparatus according to any one of paragraphs A or B, wherein said vacuum opening is approximately orthogonal to said fluid flow discharge opening.

D. The apparatus according to any one of paragraphs A or B, wherein said vacuum opening is approximately parallel to said fluid flow discharge opening.

E. The apparatus according to any one of paragraphs A or B, wherein said fluid flow conduit has a fluid flow conduit axis in line with a direction of fluid flow and wherein said vacuum conduit has a vacuum conduit axis in line with a direction of vacuum flow, wherein said fluid flow conduit axis and said vacuum conduit axis define an included angle there between, wherein said included angle is less than 90 degrees, preferably 30 degrees.

F. The apparatus according to any one of paragraphs A to E, wherein said vacuum opening and said fluid flow discharge opening are separated by 0 mm to 100 mm, more preferably 0 mm and 60 mm, most preferably 0 mm to 40 mm.

G. The apparatus according to any one of paragraphs A to E, wherein said nozzle comprises a nozzle inner surface 12 and said vacuum opening is coincident with said nozzle inner surface.

H. The apparatus according to any one of paragraphs A to E, wherein said vacuum opening is located closer to said fluid flow discharge opening than to said nozzle inlet.

I. The apparatus according to any one of paragraphs A to E, wherein said vacuum opening is located closer to said nozzle inlet than to said fluid flow discharge opening.

J. The apparatus according to any one of paragraphs A to E, further comprising a fluid flow manifold 90 in line with said fluid flow conduit between said fluid flow valve and said nozzle, and is in fluid communication with said nozzle; and
a vacuum manifold 100 in line with said vacuum conduit between said vacuum valve and said vacuum opening.

K. The apparatus according to any one of paragraphs A or J, wherein more than one said vacuum opening is spatially proximate to one said fluid flow discharge opening.

L. A process of dispensing fluid using the apparatus according to any one of paragraphs A to K comprising the steps of:
providing the apparatus according to paragraph A;
dispensing fluid from said fluid flow discharge opening;
applying a vacuum while said fluid is dispensed ending said vacuum once said fluid approaches a dosing amplitude of 0 mm.

M. The process according to paragraph L, comprising the steps of placing said fluid flow valve in said fluid flow valve open position, dispensing fluid from said fluid flow discharge opening, and placing said vacuum valve in said vacuum valve open position before placing said fluid flow valve in said fluid flow valve closed position.

N. The process according to paragraph L, wherein said apparatus dispenses said fluid into compartments 150 selected from the group consisting of thermoformed water-soluble film, water-soluble film, plastic bottles, glass bottles, and soluble-unit dose pouches.

O. The process according to paragraph L, wherein said apparatus dispenses said fluid into said compartments on a rotary drum 165.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus providing a filling cycle comprising:

a nozzle comprising a nozzle inlet and a fluid flow discharge opening in fluid communication with said nozzle inlet, wherein said fluid flow discharge opening has a fluid flow discharge opening area;

a fluid flow conduit in fluid communication with said nozzle inlet, said fluid flow conduit in fluid communication with a fluid source;

a fluid flow valve in line with said fluid flow conduit, wherein said fluid flow valve has a fluid flow valve open position and a fluid flow valve closed position;

a vacuum conduit in fluid communication with a vacuum source, said vacuum conduit comprising a vacuum opening, wherein said vacuum opening is spatially proximate to said fluid flow discharge opening, wherein said vacuum opening has a vacuum opening area, and wherein said vacuum opening area to said fluid flow discharge opening area has a ratio of less than or equal to 1;

wherein said vacuum conduit intersects said fluid flow conduit at said nozzle inner surface and a vacuum valve in line with said vacuum conduit, wherein said vacuum valve has a vacuum valve open position and a vacuum valve closed position;

wherein in a single filling cycle said vacuum valve transitions from said vacuum valve closed position to said vacuum valve open position before said fluid flow valve transitions from said fluid flow valve open position to said fluid flow valve closed position.

2. The apparatus according to claim 1, wherein said vacuum opening area to said fluid flow discharge opening area has a ratio of from about 0.1 to 1.

3. The apparatus according to claim 1, wherein said vacuum opening area to said fluid flow discharge opening area has a ratio of from about 0.4 to about 0.7.

4. The apparatus according to claim 1, wherein said vacuum opening is approximately orthogonal to said fluid flow discharge opening.

5. The apparatus according to claim 1, wherein said vacuum opening is approximately parallel to said fluid flow discharge opening.

6. The apparatus according to claim 1, wherein said fluid flow conduit has a fluid flow conduit axis in line with a direction of fluid flow and wherein said vacuum conduit has a vacuum conduit axis in line with a direction of vacuum flow, wherein said fluid flow conduit axis and said vacuum conduit axis cross at a point to define an included angle there between, wherein said included angle is less than 90 degrees.

7. The apparatus according to claim 6, wherein said included angle is about 30 degrees.

8. The apparatus according to claim 1, wherein said vacuum opening and said fluid flow discharge opening are separated by 0 mm to about 40 mm.

9. The apparatus according to claim 1, wherein said nozzle comprises a nozzle inner surface and said vacuum opening is coincident with said nozzle inner surface.

10. The apparatus according to claim 1, wherein said vacuum opening is located closer to said fluid flow discharge opening than to said nozzle inlet.

11. The apparatus according to claim 1, wherein said vacuum opening is located closer to said nozzle inlet than to said fluid flow discharge opening.

12. An apparatus providing a filling cycle comprising:

a plurality of nozzles, each said nozzle comprising a nozzle inlet and a fluid flow discharge opening in fluid communication with said nozzle inlet, wherein said fluid flow discharge opening has a fluid flow discharge opening area;

a plurality of fluid flow conduits, each fluid flow conduit in fluid communication with a single nozzle inlet, said plurality of fluid flow conduits in fluid communication with a fluid source;

a fluid flow valve in line with said plurality of fluid flow conduits, wherein said fluid flow valve has a fluid flow valve open position and a fluid flow valve closed position;

a fluid flow manifold in line with said plurality of fluid flow conduits between said fluid flow valve and said plurality of nozzles, and is in fluid communication with said plurality of nozzles;

a plurality of vacuum conduits in fluid communication with a vacuum source, each said vacuum conduit comprising a vacuum opening, wherein said vacuum opening is spatially proximate to said fluid flow discharge opening and wherein said vacuum opening has a vacuum opening area, wherein said vacuum opening area to said fluid flow discharge opening area has a ratio of less than or equal to 1;

wherein said vacuum conduit intersects said fluid flow conduit at said nozzle inner surface;

a vacuum valve in line with said plurality of vacuum conduits, wherein said vacuum valve has a vacuum valve open position and a vacuum valve closed position;

a vacuum manifold in line with said plurality of vacuum conduits between said vacuum valve and said vacuum opening, and wherein in a single filling cycle said vacuum valve transitions from said vacuum valve closed position to said vacuum valve open position before said fluid flow valve transitions from said fluid flow valve open position to said fluid flow valve closed position.

13. The apparatus according to claim 12, wherein more than one said vacuum opening is spatially proximate to one said fluid flow discharge opening.

14. A process of dispensing fluid comprising the steps of:

providing an apparatus wherein said apparatus comprises a nozzle wherein said nozzle comprises a fluid flow discharge opening;

dispensing fluid from said fluid flow discharge opening; and applying a vacuum while said fluid is dispensed;

wherein said nozzle further comprises a nozzle inlet in fluid communication with said fluid flow discharge opening; and wherein said apparatus further comprises a fluid flow conduit in fluid communication with said nozzle inlet; a fluid flow valve in line with said fluid flow conduit, wherein said fluid flow valve has a fluid flow valve open position and a fluid flow valve closed position; a vacuum conduit in fluid communication with a vacuum source, said vacuum conduit comprising a vacuum opening wherein said vacuum opening is spatially proximate to said fluid flow discharge opening; wherein said vacuum conduit intersects said fluid flow conduit at said nozzle inner surface; and a vacuum valve in line with said vacuum conduit, wherein said vacuum valve has a vacuum valve open position and a vacuum valve closed position; and wherein said fluid flow valve and said vacuum valve are coupled, wherein the process further comprises the steps of placing said fluid flow valve in said fluid flow valve open position, dispensing fluid from said fluid flow discharge opening, and placing said vacuum valve in said vacuum valve open position before placing said fluid flow valve in said fluid flow valve closed position.

15. The process according to claim 14, comprising the step of ending said vacuum once said fluid approaches a dosing amplitude of 0 mm.

16. The process according to claim 14, wherein said apparatus dispenses said fluid into compartments selected from the group consisting of thermoformed water-soluble film, water-soluble film, plastic bottles, glass bottles, and soluble-unit dose pouches.

17. The process according to claim 16, wherein said apparatus dispenses said fluid into said compartments, wherein said compartments are at or near the top of a rotary drum.

* * * * *